US007905633B2

(12) United States Patent
Horng et al.

(10) Patent No.: US 7,905,633 B2
(45) Date of Patent: Mar. 15, 2011

(54) LIGHT EMITTER WITH HEAT-DISSIPATING MODULE

(75) Inventors: Alex Horng, Kaohsiung (TW); Masaharu Miyahara, Kaohsiung (TW); Chih-Hao Chung, Kaohsiung (TW)

(73) Assignee: Sunonwealth Electronic Machine Industry Co., Ltd., Kaohsiung (TW)

( * ) Notice: Subject to any disclaimer, the term of this patent is extended or adjusted under 35 U.S.C. 154(b) by 179 days.

(21) Appl. No.: 12/422,010

(22) Filed: Apr. 10, 2009

(65) Prior Publication Data

US 2010/0259932 A1 Oct. 14, 2010

(51) Int. Cl.
*F21V 29/00* (2006.01)

(52) U.S. Cl. ..... 362/294; 362/373; 362/547; 257/712; 257/722

(58) Field of Classification Search ..... 362/294, 362/373, 547, 218; 257/712, 722
See application file for complete search history.

(56) References Cited

U.S. PATENT DOCUMENTS 6,864,513 B2 3/2005 Lin et al.
7,180,956 B1 * 2/2007 Banister ..... 375/267
7,196,459 B2 3/2007 Morris
7,467,882 B2 12/2008 Chang et al.
7,654,703 B2 * 2/2010 Kan et al. ..... 362/362
7,674,012 B1 * 3/2010 Lin et al. ..... 362/249.02
7,771,088 B2 * 8/2010 Chen ..... 362/294

FOREIGN PATENT DOCUMENTS

TW M334919 6/2008
TW M339202 8/2008

* cited by examiner

*Primary Examiner* — Ali Alavi
(74) *Attorney, Agent, or Firm* — Muncy, Geissler, Olds & Lowe, PLLC

(57) ABSTRACT

A light emitter with heat-dissipating module includes a light unit, a first heat-dissipating member, a second heat-dissipating member and a fastening member. The light unit includes a light-emitting element and a supporting plate having a pair of opposite surfaces. The first heat-dissipating member includes a first combining surface and a heat-dissipating portion. The first combining surface contacts with one of said two opposite surfaces of the supporting plate. The second heat-dissipating member includes a second combining surface and a heat-dissipating portion. The second combining surface contacts with the other of said two opposite surfaces of the supporting plate. The fastening member couples to the supporting plate, the first heat-dissipating member and the second heat-dissipating member to fix the combination of the supporting plate and the first and second heat-dissipating members.

8 Claims, 6 Drawing Sheets

LIGHT EMITTER WITH HEAT-DISSIPATING MODULE

BACKGROUND OF THE INVENTION

1. Field of the Invention

The present invention relates to a light emitter and, more particularly, to a light emitter including a heat-dissipating module for transmitting heat generated from a light unit of the light emitter.

2. Description of the Related Art

Taiwan Utility Model Publication No. M334919 entitled "Improved Structure of LED Lamp Device" is an example of a conventional light emitter with heat-dissipating module and discloses a heat sink mounted inside a housing and attaching to the back of a LED base-plate. A heat-dissipating fan is further arranged beside the heat sink, with the heat sink being arranged between the LED base-plate and the heat-dissipating fan. Thus, air can be drawn into the housing to transfer heat of the LED base-plate out of the housing.

Furthermore, another conventional light emitter with heat-dissipating module is disclosed in Taiwan Utility Model Publication No. M339202 entitled "Heat-dissipating Structure of LED Lamp Device", which includes LEDs mounted in a housing having an assembling hole. A side edge of the housing, which delimits the assembling hole, forms a groove for adhesive being applied to. And a lens is stuck to the housing by the adhesive and covers the assembling hole for rays of light from the LEDs to penetrate. Besides, there are plural fins formed on an outer surface of the housing to form a heat sink. Therefore, heat of the LEDs is dissipated via convection by the fins.

Nevertheless, light source of each of the above-mentioned conventional light emitters, which generate heat, is combined with the heat sink merely through single-surface contact. Additionally, the back of each light source may not fully contact with the heat sink. Thus, heat generated by each of the LED base-plate and LEDs is conducted to the heat sink only through a small contact area between the heat sink and the LED base-plate or LEDs to reduce heat dissipating efficiency. Besides, using the heat-dissipating fan to draw air to dissipate heat will complicate the structure and enlarge the overall volume of the light emitter. Therefore, it's difficult to improve the design of the conventional light emitter with heat-dissipating module to achieve miniature and light features.

Generally, if the back of each light source of the two conventional light emitters is assured to fully contact with the heat sink or the contact area between the heat sink and the LED base-plate or LEDs is increased, heat from the LED base-plate and LEDs can be transferred to the ambient environment effectively. Hence, there is a need for an improvement over the conventional light emitter with heat-dissipating module.

SUMMARY OF THE INVENTION

It is therefore the primary objective of this invention to provide a light emitter with heat-dissipating module that enhance heat dissipation by combining a supporting plate of a light unit with a heat-dissipating member tightly and reliably to increase thermal conductive area.

The second objective of the present invention is to provide a light emitter with heat-dissipating module that has simplified structure and a small volume resulted from tight and reliable combination of the supporting plate and the heat-dissipating member for miniaturizing and lightening products.

A light emitter with heat-dissipating module according to the preferred teachings of the present invention includes a light unit, a first heat-dissipating member, a second heat-dissipating member and a fastening member. The light unit includes a light-emitting element and a supporting plate having a pair of opposite surfaces. The first heat-dissipating member includes a first combining surface and a heat-dissipating portion. The first combining surface contacts with one of said two opposite surfaces of the supporting plate. The second heat-dissipating member includes a second combining surface and a heat-dissipating portion. The second combining surface contacts with the other of said two opposite surfaces of the supporting plate. The fastening member couples to the supporting plate, the first heat-dissipating member and the second heat-dissipating member to fix the combination of the supporting plate and the first and second heat-dissipating members.

Further scope of the applicability of the present invention will become apparent from the detailed description given hereinafter. However, it should be understood that the detailed description and specific examples, while indicating preferable embodiments of the invention, are given by way of illustration only, since various will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
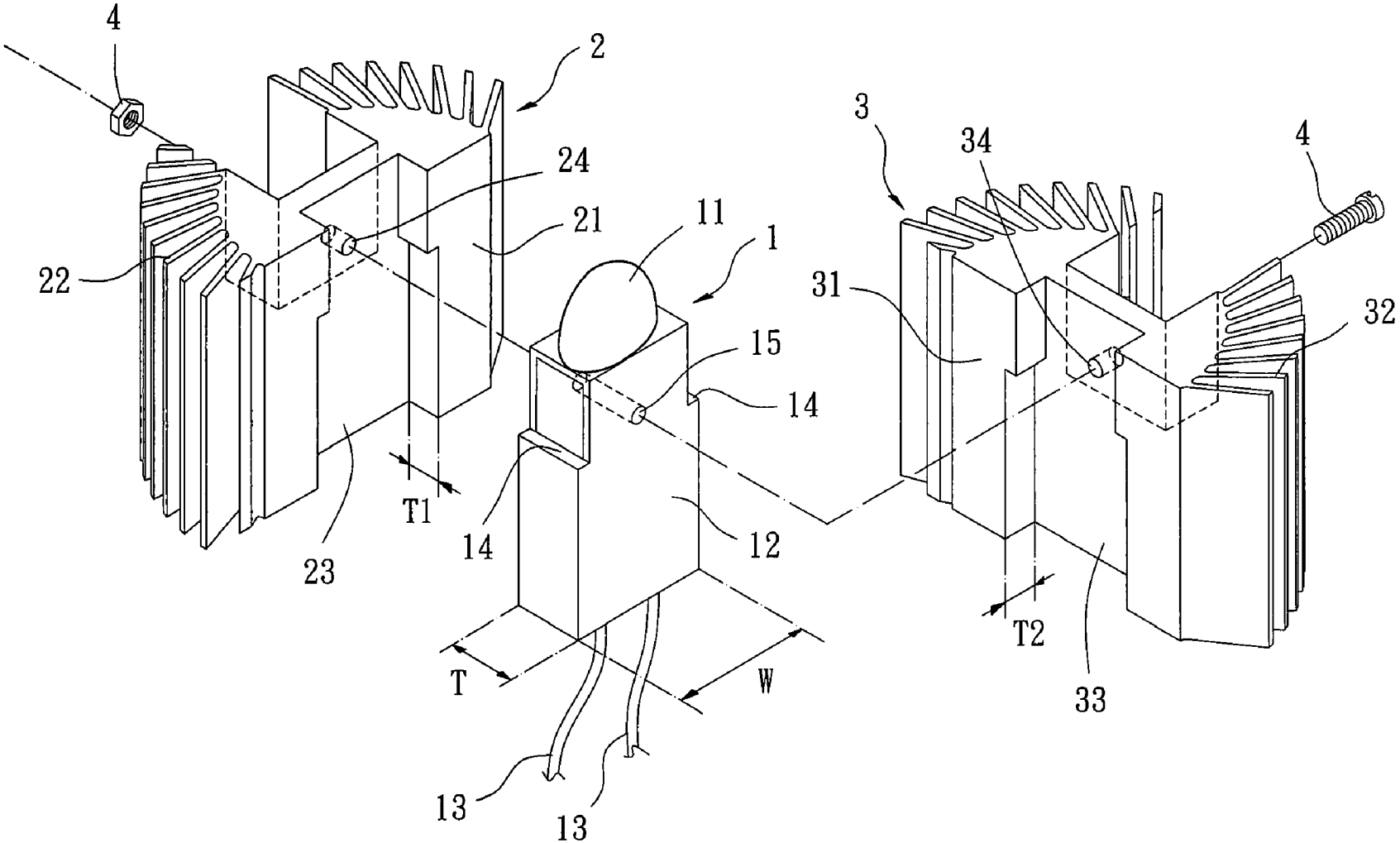
FIG. 1 is an exploded view illustrating a light emitter with heat-dissipating module in accordance with a first embodiment of the present invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "lower", "upper", "portion", "width", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A light emitter with heat-dissipating module according to the preferred teachings of the present invention is shown in FIGS. 1-6 of the drawings and includes a light unit 1, a first heat-dissipating member 2, a second heat-dissipating member 3 and a fastening member 4. The light unit 1 is sandwiched between and partially received in the first heat-dissipating member 2 and the second heat-dissipating member 3, and the fastening member 4 fixes the combination of them.

The present invention is characterized in that plural surfaces of the light unit 1 contact with the first heat-dissipating member 2 and the second heat-dissipating member 3 tightly for facilitating heat dissipation via conduction.

Specifically, as an example of the idea disclosed by the light emitter with heat-dissipating module mentioned above, a first embodiment according to the preferred teachings of the present invention is applied to an LED lamp, described in the following and further shown in FIGS. 1-3.

Now referring to FIG. 1, the light unit 1 includes a light-emitting element 11 selected from LEDs and a supporting plate 12 adapted for the light-emitting element 11 to be mounted to. The supporting plate 12 has a chipset therein, which connects to the light emitting-element 11, with a power line 13 being electrically connected to the chipset to energize the light-emitting element 11. The supporting plate 12 has a pair of opposite surfaces those are both preferable planes. Furthermore, the supporting plate 12 has a width "W" and a thickness "T", wherein the width "W" is also a width of each of the opposite surfaces, and the thickness "T" is a distance between the two opposite surfaces. Optionally, by providing the supporting plate 12 with different widths or thicknesses, at least one positioning shoulder 14 is formed. In this embodiment as shown in FIG. 1, a number of the at least one positioning shoulders 14 is two while a width of an upper part of the supporting plate 12 is smaller than that of a lower part of the supporting plate 12 to provide a reliable combination of the first heat-dissipating member 2, the second heat-dissipating member 3 and the light unit 1. Besides, there is a first through-hole 15 passing through the supporting plate 12, and the first through-hole 15 preferably connects with said at least two opposite surfaces of the supporting plate 12.

Still referring to FIG. 1, the first heat-dissipating member 2 is made of thermal conductive material and has a first combining surface 21 and a heat-dissipating portion 22. The first combining surface 21 is able to mostly contact with one of said two opposite surfaces of the supporting plate 12 and preferable a plane. The heat-dissipating portion 22 is used to be exposed to the ambient environment and can be designed as any conventional heat-dissipating structure, such as fins or holes, to increase surface area of the heat-dissipating portion 22 and thus enhance heat dissipation via convection.

In order to increase contact area between and reliability of combination of the light unit 1 and the first heat-dissipating member 2, there is a first recess 23 formed in the first combining surface 21 of the first heat-dissipating member 2. The first recess 23 is in a shape fitting the shape of the supporting plate 12 and a depth "T1" of the first recess 23 is equal to half the thickness "T" of the supporting plate 12. Moreover, the first heat-dissipating member 2 has a second through-hole 24 passing through the first combining surface 21 and a surface opposite to the first combining surface 21 for the insertion of the fastening member 4. Preferably, the second through-hole 24 is arranged in the first recess 23 and aligns with the first through-hole 15 of the light unit 1.

Referring again to FIG. 1, the light unit 1 is sandwiched between the second heat-dissipating member 3 and the first heat-dissipating member 2, with the supporting plate 12 being inserted in the first heat-dissipating member 2 and the second heat-dissipating member 3 at the same time. Preferably, the first heat-dissipating member 2 and the second heat-dissipating member 3 are identical, so that the heat-dissipating members 2, 3 can be formed by the same mold and convenience of assembling is also improved. Furthermore, the second heat-dissipating member 3 has a second combining surface 31, a heat-dissipating portion 32, a second recess 33 and a third through-hole 34, wherein the second combining surface 31, the second recess 33 and the third through-hole 34 respectively face and align with the first combining surface 21, the first recess 23 and the second through-hole 24 of the first heat-dissipating member 2. The second recess 33 has a depth "T2" equal to half the thickness "T" of the supporting plate 12.

The fastening member 4 is used to combine the first heat-dissipating member 2 and the second heat-dissipating member 3 together, with the light unit 1 being fixed between the two heat-dissipating members 2, 3. The fastening member 4 can be selected from any conventional structure, such as a bolt and a nut as shown in the drawings. Optionally, inner surfaces of the second through-hole 24 and the third through-hole 34 both form threads for the bolt to engage with, so as to fasten the first heat-dissipating member 2 and the second heat-dissipating member 3 without a nut. Alternatively, the fastening member 4 can be designed as engaging hooks and engaging holes directly formed on the first and second heat-dissipating members 2, 3 and the supporting plate 12.

Figure 2:
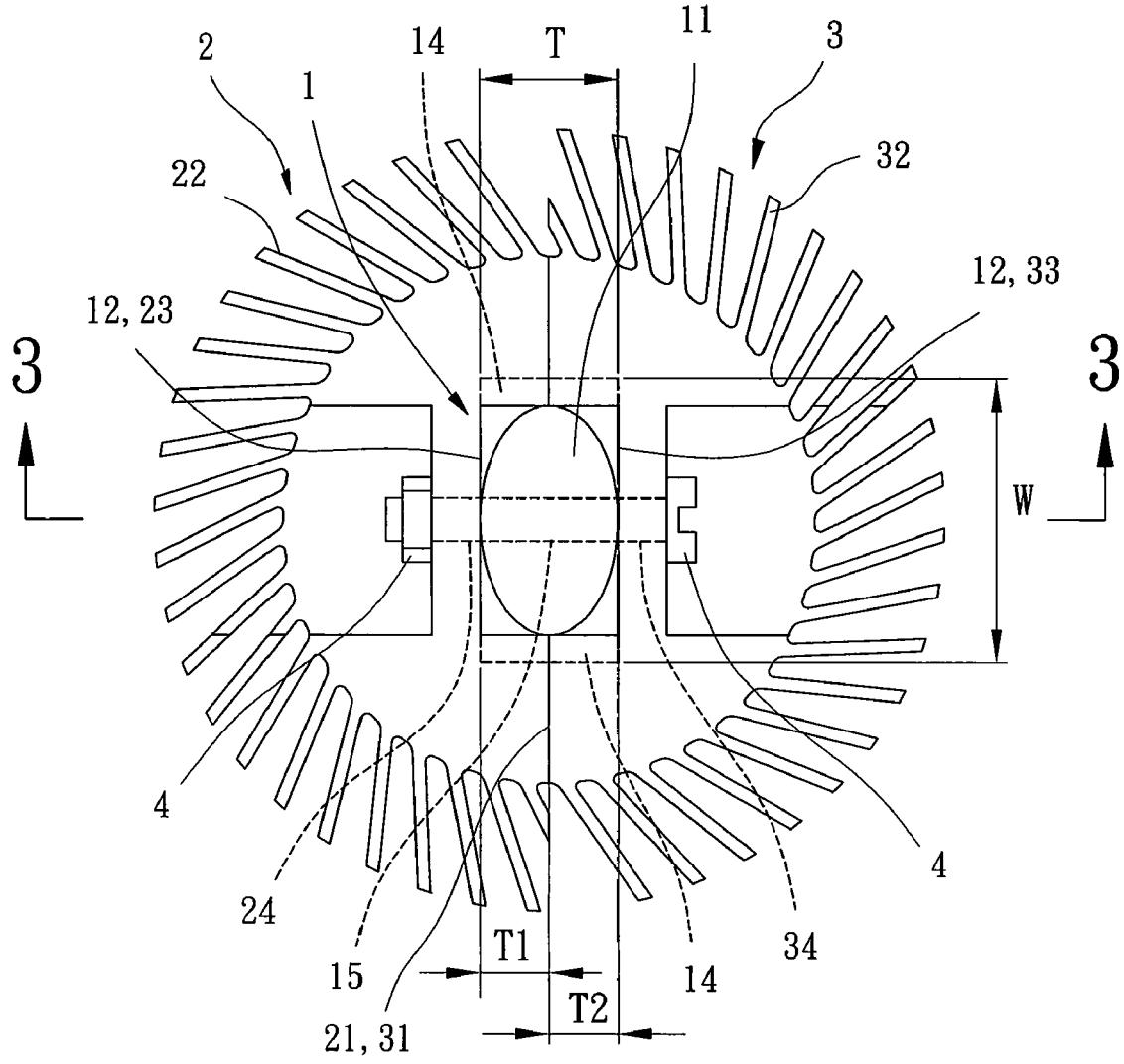
FIG. 2 is a top view illustrating the light emitter with heat-dissipating module of FIG. 1.
Figure 3:
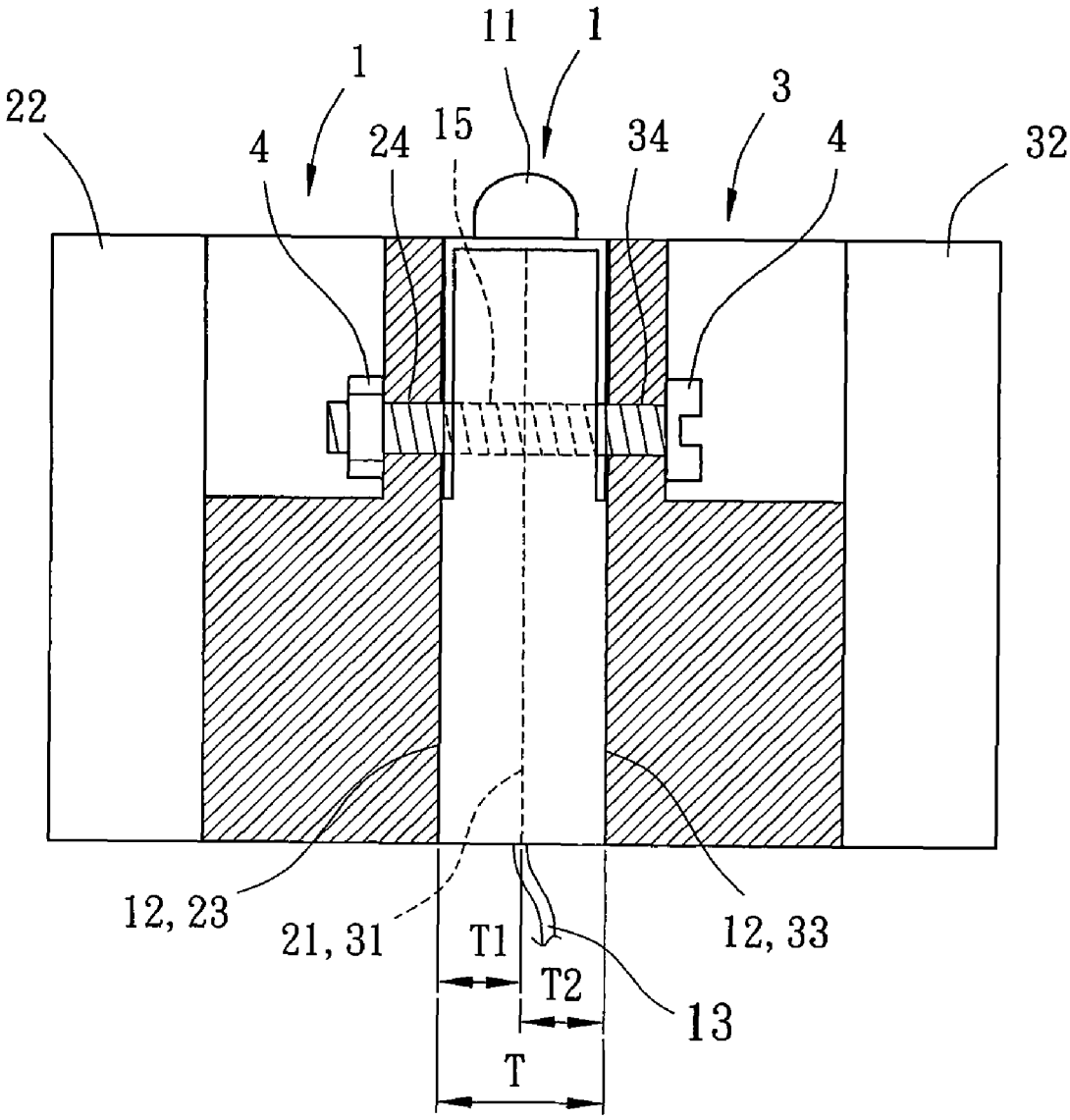
FIG. 3 is a cross sectional view illustrating the light emitter with heat-dissipating module of FIG. 2 according to section line 3-3 of FIG. 2.

In assembly, referring to FIGS. 2 and 3, the light unit 1 is arranged between the first heat-dissipating member 2 and the second heat-dissipating member 3, and then the bolt, namely the fastening member 4, sequentially passes through the second through-hole 24 of the first heat-dissipating member 2, the first through-hole 15 of the light unit 1 and the third through-hole 34 of the second heat-dissipating member 3. While both of the depths "T1", "T2" of the first and second recesses 23, 33 of the first and second heat-dissipating member 2, 3 are equal to half the thickness "T" of the supporting plate 12, the first and second heat-dissipating member 2, 3 can fully enclose and contact with the supporting plate 12 of the light unit 1. Therefore, thermal conductive area between the light unit 1 and the first and second heat-dissipating members 2, 3 is enlarged, and thus heat-transfer efficiency for heat generated by the chipset of the light unit 1 to be dissipated is improved. Besides, thermal grease is optionally spread over the first and second combining surfaces 21, 31, including walls delimiting the first and second recesses 23, 33 or not, of the first and second heat-dissipating members 2, 3, where touch the supporting plate 12, so as to assist the first and second heat-dissipating members 2, 3 to draw heat away from the light unit 1.

Figure 4:
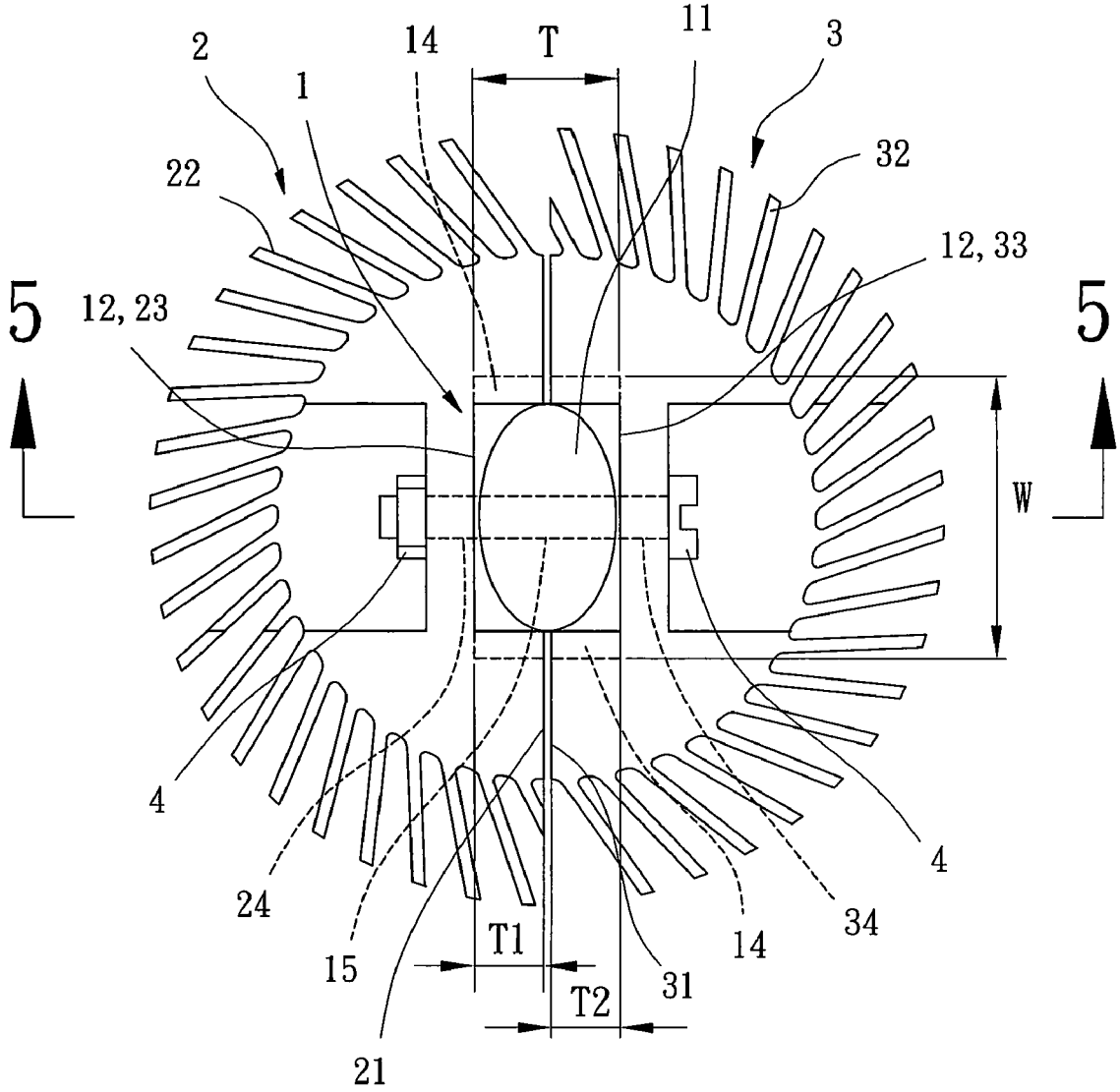
FIG. 4 is a top view illustrating a light emitter with heat-dissipating module in accordance with a second embodiment of the present invention.
Figure 5:
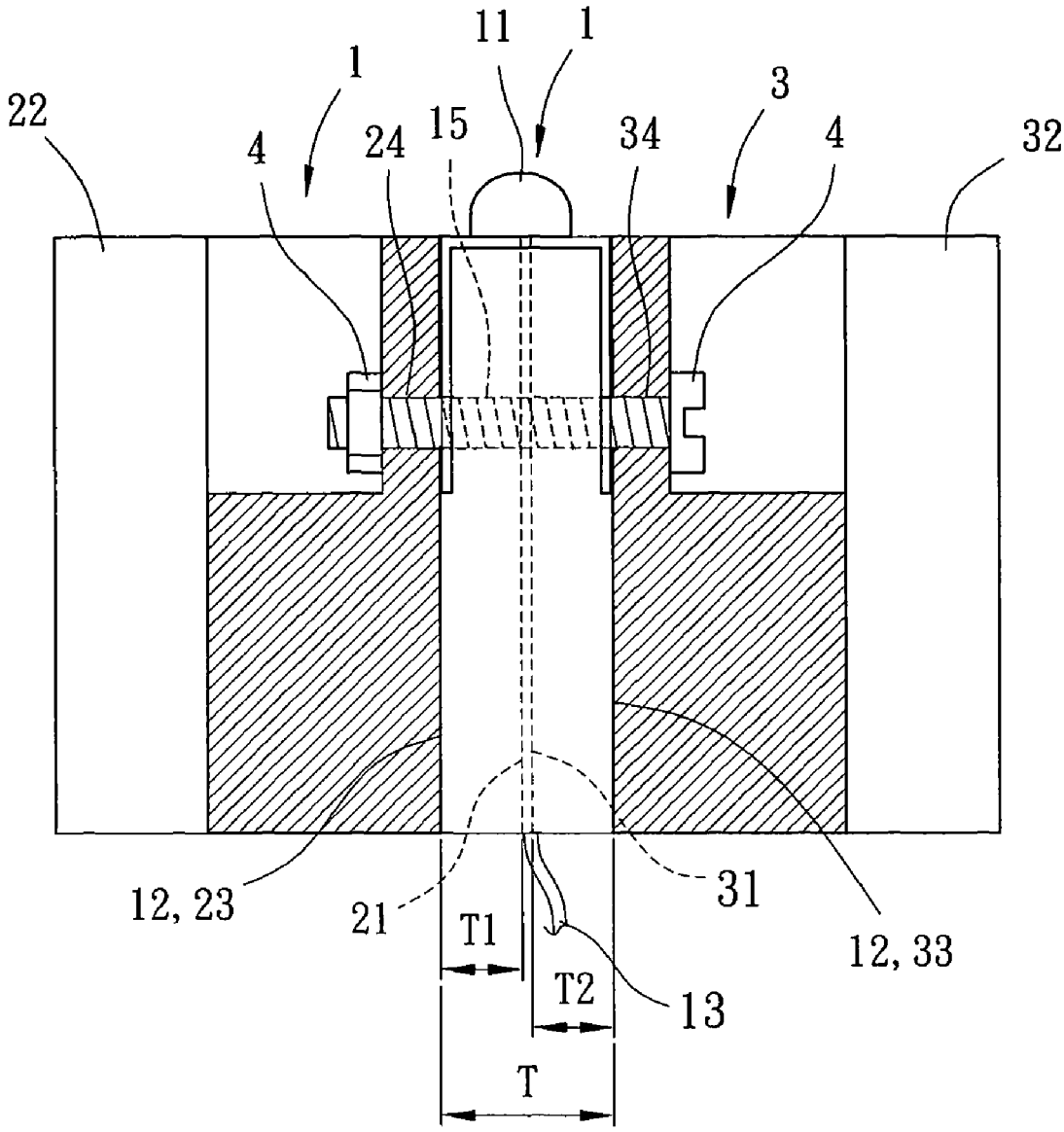
FIG. 5 is a cross sectional view illustrating the light emitter with heat-dissipating module of FIG. 4 according to section line 5-5 of FIG. 4.

FIGS. 4 and 5 show a light emitter with heat-dissipating module of a second embodiment according to the preferred teachings of the present invention. In the preferred form shown, both of the depth "T1" of the first recess 23 of the first heat-dissipating member 2 and the depth "T2" of the second recess 33 of the second heat-dissipating member 3 are smaller than half the thickness "T" of the supporting plate 12. Although the first and second combining surfaces 21, 31 of the first and second heat-dissipating members 2, 3 doesn't touch each other while the light unit 1 and the first and second heat-dissipating members 2, 3 are combined by the fastening member 4, the first and second combining surfaces 21, 31 still firmly attach to the opposite surfaces of the supporting plate 12. Thus, an enlarged thermal conductive area is still provided for heat from the chipset of the light unit 1 to be conducted to the first and second heat-dissipating members 2, 3. Also, the first and second combining surfaces 21, 31 of the first and second heat-dissipating members 2, 3, including or except for walls delimiting the first and second recesses 23, 33, are spread with thermal grease to aid thermal dissipation of the light unit via the first and second heat-dissipating members 2, 3.

It can be appreciated that thermal conduction is still provided while the depth "T1" of the first recess 23 and the depth "T2" of the second recess 33 are different, with a total of the depths "T1" and "T2" being equal to or smaller than the depth "T" of the support plate 12.

Figure 6:
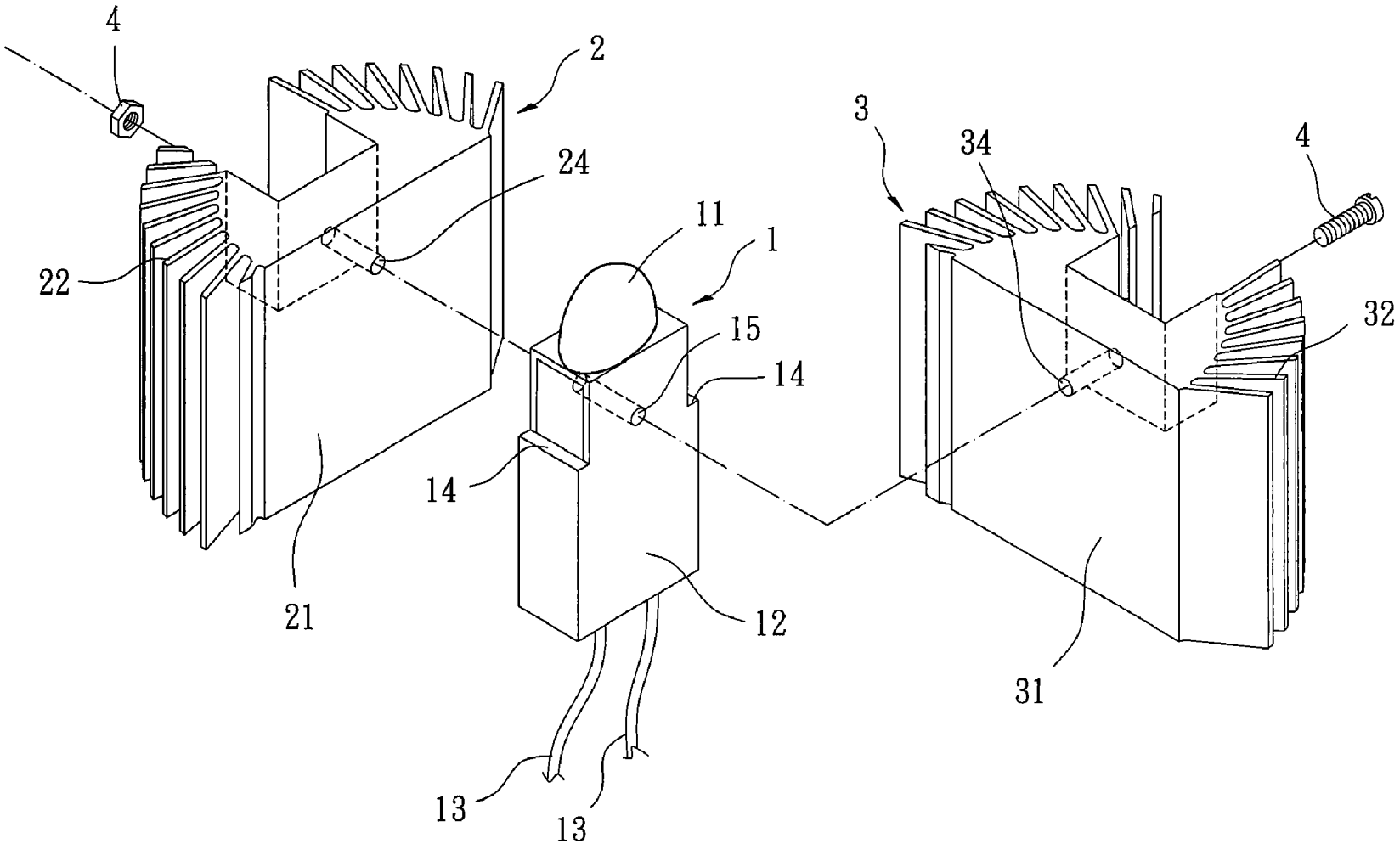
FIG. 6 is an exploded view illustrating a light emitter with heat-dissipating module in accordance with a third embodiment of the present invention.

FIG. 6 shows a light emitter with heat-dissipating module of a third embodiment according to the preferred teachings of the present invention. In the preferred form shown, each of the first heat-dissipating member 2 and second heat-dissipating member 3 does not form any recess in the first or second combining surface 21, 31 thereof. Hence, whatever the shape of the supporting plate 12 is, the first and second heat-dissipating members 2, 3 can be mounted to it, with the supporting plate 12 having said at least two plane surfaces.

As has been discussed above, the light unit 1 and the first and second heat-dissipating members 2, 3 are combined tightly and securely to provide large thermal conductive area for the light unit 1, so that heat from the light unit 1 is transferred to the ambient environment effectively to enhance heat dissipation. Therefore, mounting a fan to the light unit 1 for heat dissipation is unnecessary to simplify the structure of the light emitter with heat-dissipating module of the present invention, so that miniaturization and lightening of products are achieved.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A light emitter with heat-dissipating module comprising:

a light unit including a light-emitting element and a supporting plate having a pair of opposite surfaces;

a first heat-dissipating member including a first combining surface contacting with one of said two opposite surfaces of the supporting plate, and a heat-dissipating portion;

a second heat-dissipating member including a second combining surface contacting with the other of said two opposite surfaces of the supporting plate, and a heat-dissipating portion; and a fastening member coupling to the supporting plate, the first heat-dissipating member and the second heat-dissipating member to fix the combination of the supporting plate and the first and second heat-dissipating members.

2. The light emitter with heat-dissipating module as defined in claim 1, wherein the first heat-dissipating member and the second heat-dissipating member are identical.

3. The light emitter with heat-dissipating module as defined in claim 1, wherein there is a first recess formed in the first combining surface of the first heat-dissipating member and there is a second recess formed in the second combining surface of the second heat-dissipating member.

4. The light emitter with heat-dissipating module as defined in claim 3, wherein the first and second recesses are in a shape fitting the shape of the supporting plate.

5. The light emitter with heat-dissipating module as defined in claim 4, wherein the supporting plate forms at least one positioning shoulder while the supporting plate has different widths or thicknesses.

6. The light emitter with heat-dissipating module as defined in claim 4, wherein the supporting plate has a thickness that is a distance between the two opposite surfaces, with depths of the first and second recesses are equal to or smaller than half the thickness of the supporting plate.

7. The light emitter with heat-dissipating module as defined in claim 1, wherein there is a first through-hole passing through the supporting plate, the first heat-dissipating member has a second through-hole and the second heat-dissipating member has a third through-hole, with said three through-holes aligning with each other for the fastening member to pass through.

8. The light emitter with heat-dissipating module as defined in claim 7, wherein the second through-hole is arranged in the first recess and the third through-hole is arranged in the second recess.

* * * * *